United States Patent [19]

Ellenberger

[11] 3,938,065

[45] Feb. 10, 1976

[54] PUSH-BUTTON OPERATED BIPOLAR FAULTY CURRENT PROTECTIVE SWITCH

[75] Inventor: Jakob Ellenberger, Altendorf, near Nurnberg, Germany

[73] Assignee: Ellenberger & Poensgen GmbH, Altendorf, near Nurnberg, Germany

[22] Filed: July 12, 1974

[21] Appl. No.: 488,299

[30] Foreign Application Priority Data

July 31, 1973 Germany ..... 2338738

[52] U.S. Cl. ..... 335/24; 335/35; 317/18 D

[51] Int. Cl.[2] ..... H01H 83/00

[58] Field of Search ..... 335/24, 21, 18, 35; 317/18 D

[56] References Cited

UNITED STATES PATENTS

| | | | |
|---|---|---|---|
| 2,895,028 | 7/1959 | Ellenberger | 335/35 X |
| 2,958,751 | 11/1960 | Camp | 335/21 X |
| 3,307,124 | 2/1967 | Ellenberger | 335/35 |
| 3,324,429 | 6/1967 | Ellenberger | 335/35 |

*Primary Examiner*—G. Harris

*Attorney, Agent, or Firm*—Spencer & Kaye

[57] ABSTRACT

This invention relates to a push-button operated bipolar, faulty current protective switch, with a trip-free release and a switched-on position that is not affected by the push-button.

Such a circuit breaker includes a bell crank and a switching bar which is controlled by an electromagnetic tripping device.

6 Claims, 6 Drawing Figures

PUSH-BUTTON OPERATED BIPOLAR FAULTY CURRENT PROTECTIVE SWITCH

This invention relates to a push-button operated bipolar faulty current protective switch having two fixed contacts, and co-operating therewith, two movable contacts, and an electromagnetic tripping device which is actuated in dependence on the fault current.

The known earth-leakage circuit breakers are of a relatively large size, have no instantaneous switching-on facility and sometimes also no trip-free release.

The invention is concerned with the problem of designing a circuit breaker of the above described kind in the most space-saving manner possible, in such manner that it switches both circuits simultaneously on or off, that it has instantaneous switching off and instantaneous switching on facilities and trip-free release and that its switched on or connection position cannot be altered by actuating the push-button.

According to the present invention there is provided a push-button operated bipolar faulty current protective switch having two fixed contacts co-operating with two movable contacts and an electromagnetic tripping device which is actuated in dependence on a faulty current, such a circuit breaker comprising a switching bar, a bell crank made of electrically insulating material, a spring biased pushbutton rigidly connected to the switching bar, the bell crank including first and second leg members, the first leg member being arranged transversely of the switching bar so that it is freely pivotable thereon and displaceable axially thereof, the second leg member being arranged parallel to the switching bar and having a cross member of an insulating material pivotally mounted about an axis substantially parallel to the switching bar and being provided at each of its ends with one of the movable contacts, the switching bar including a drive member adapted to engage an abutment on the second leg member in the switched off condition of the bell crank, a stop member for maintaining the bell crank at an angle to the switching bar in the switched off condition of the bell crank so that it can be moved to the switched on condition, the electromagnetic tripping device including an armature provided with a protuberance adapted to maintain the bell crank in its switched on condition against the bias of a spring.

This construction of circuit breaker firstly provides the possibility of both current circuits being simultaneously switched on or off. As soon as the faulty current has reached a specific value the electromagnet attracts the armature so that the latter releases the bell crank and, due to the spring, the bell crank jerks into its switched off position, whereby instantaneous switching off is obtained. In this switched off position the stop member positions the bell crank obliquely so that during the switching on movement of the push-button and the switching bar the drive member disposed on the switching bar entrains the bell crank and causes it to engage behind the protuberance of the armature of the electromagnetic tripping device. As soon as the first leg of the bell crank has engaged behind the protuberance and the push button is thereafter released there results, under the effect of the spring, a pivoting movement of the bell crank about the protuberance of the armature as fulcrum. During this pivoting movement of the bell crank and before the latter has reached its switched on position its abutment slides off the drive member of the switching bar so that the bell crank acted upon by the spring then performs a jerky pivoting movement and the two movable contacts also abruptly come into contact with the fixed contacts, whereby instantaneous switching on has been obtained. In the switched on position of the bell crank or of the movable contacts the abutment of the bell crank is not within the range of travel of the drive member of the switching bar, so that when the push button is actuated with the bell crank in the switched on position this position of the bell crank or of the movable contacts cannot be altered. In the present circuit breaker sparking in the switched on position is thus precluded. Consequently and by virtue of the instantaneous switching on and off facilities the movable and the fixed contacts are protected against wear so that the circuit breaker has a long useful life. The fact that a bell crank of insulating material mounted to be pivotable and to be displaceable in axial direction of the switching bar is employed provides the advantage of a space-saving construction. Automatic contact pressure compensation is obtained by virtue of the cross member carrying the movable contacts being pivotably mounted in the bell crank. As a result of the abutment of the bell crank not being within the range of travel of the drive member of the switching bar in the switched on position release is also possible when the push-button is jammed or held fast in the depressed position. Since the disconnection spring is then inactive, the compression spring moves the bell crank into the switched off position. This release is a trip-free release.

In one form each of the movable contacts is arranged on one arm of a U-shaped carrier on the cross member, the other arm of the said carrier being in electrical contact with a terminal of the circuit breaker.

Preferably, the axial displaceable movement of the bell crank is achieved by means of aligned members on the first leg of the bell crank which are guided in grooves which extend in the direction of movement of the push-button. Further, the switching bar may include shoulders which are also guided in the grooves.

Conveniently the circuit breaker may include a detector circuit for detecting a faulty current, the detector circuit being connected to the electromagnetic tripping device.

In one form the circuit breaker includes a pivotable contact spring provided with a terminal member, the said spring being movable into contact with a terminal for the circuit breaker in the switched on position by means of a member on the switching bar.

The circuit breaker may also include an additional pair of contacts, one of which is movable and the other of which is fixed, and a test key for actuating the further pair of contacts in order to energise the electromagnetic tripping device.

Further, the present circuit breaker may conveniently be incorporated in a conventional socket.

An illustrative embodiment of the invention will now be described with reference to the accompanying drawings, in which:-

Figure 1:
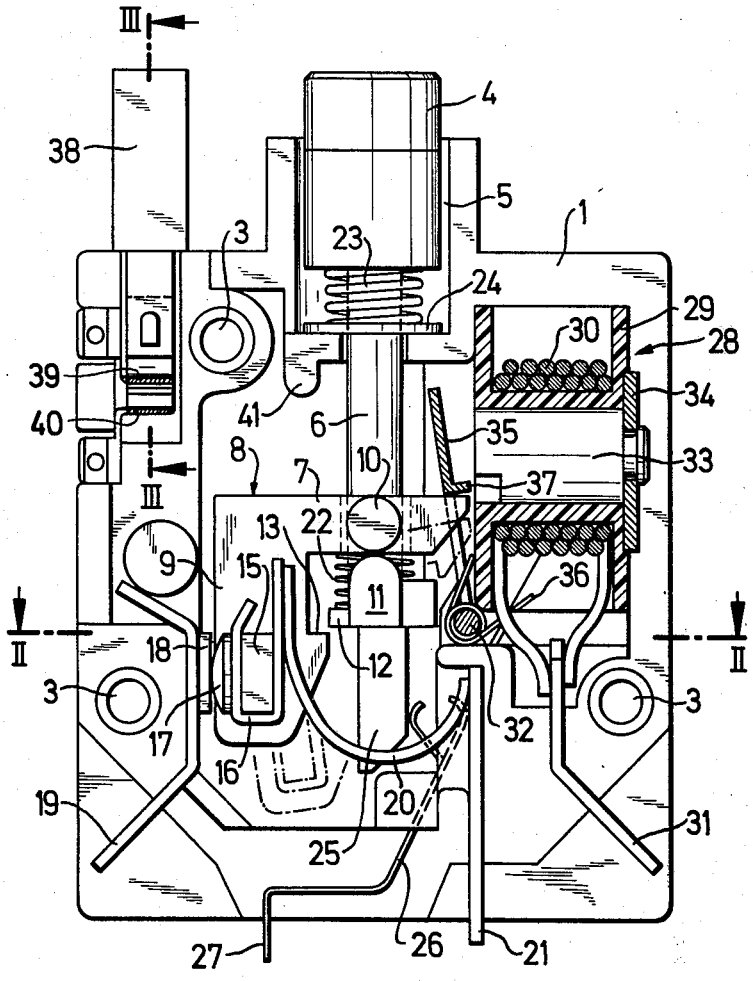
FIG. 1 shows a cross-sectional view of one form of the present circuit breaker in its switched on condition.

Referring now to the drawings, there is shown a circuit breaker having a housing comprised of two dish-shaped halves, or members 1 and 2, of dielectric material which halves may be connected to one another by tubular rivets passing through corresponding bores. A push-button 4 is mounted for vertical displacement in respective corresponding recesses 5 of each housing members 1, 2. The push-button 4 which is of insulating material is detent fitted or snap fitted by undercuts onto a switching bar 6 of insulating material and consequently rigidly connected with the switching bar 6. To the switching bar 6 there is mounted, with a relatively great clearance so as to be displaceable in axial direction of the switching bar 6, a leg 7 of a bell crank 8 of insulating material. The leg 7 is situated transversely of the switching bar 6 and the arrangement is such that the bell crank 8 which additionally possesses a second leg 9 can also be pivoted relative to the switching bar 6. Lateral pins 10, of circular cross-section, of the leg 7 are supported on shoulders 11 of the switching bar 6. Both the pins 10 and the shoulders 11 are displaceably guided in corresponding vertical grooves of the parallel oppositely located walls of two housing members 1, 2. In the region of the shoulders 11 the switching bar 6 has a drive member 12 capable of co-operating with an abutment 13 of the leg 9 of the bell crank 8.

Figure 2:
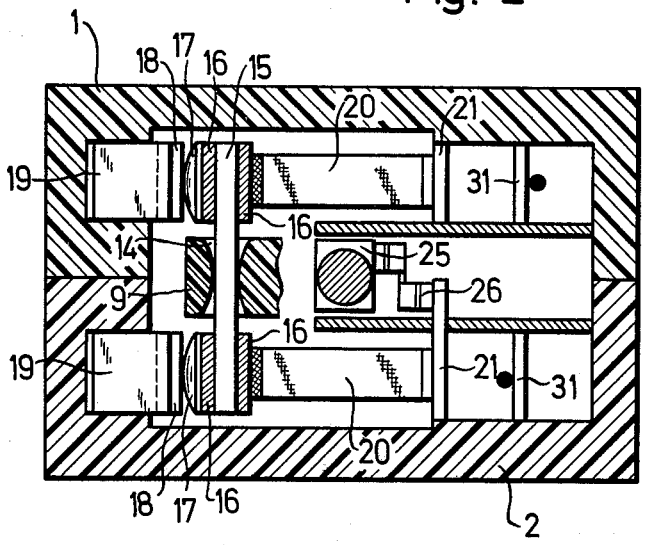
FIG. 2 shows a section taken along line II—II of FIG. 1.
Figure 3:
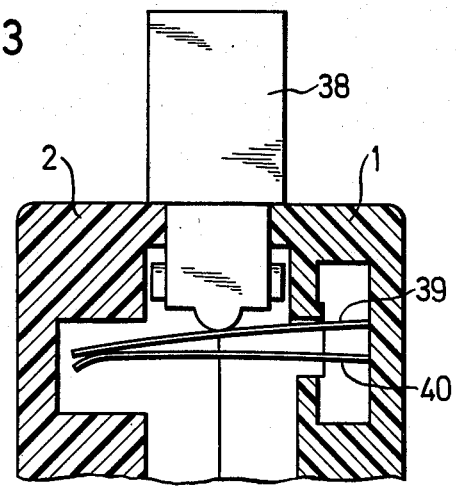
FIG. 3 shows a section taken along line III—III of FIG. 1.
Figure 4:
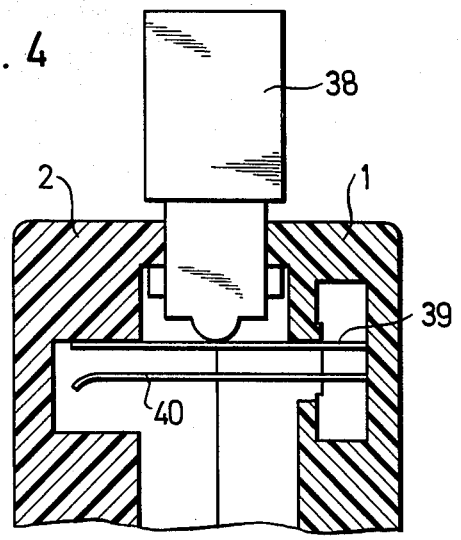
FIG. 4 shows a section taken along line IV—IV of FIG. 5.
Figure 6:
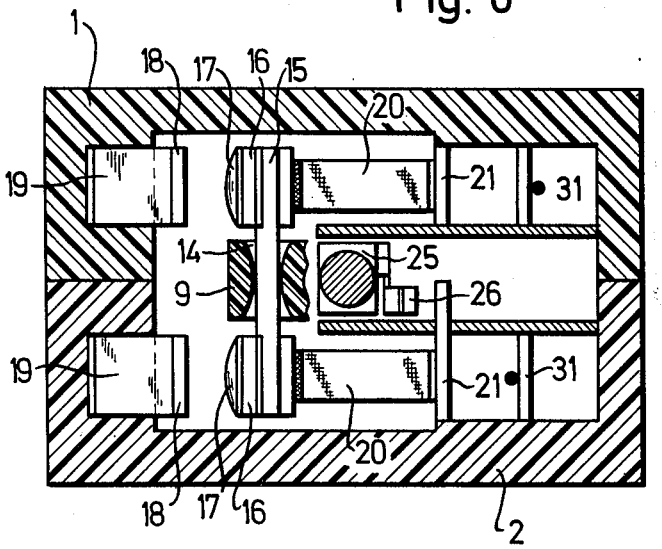
FIG. 6 shows a section taken along line VI—VI of FIG. 5.

As is apparent from FIG. 2, the leg 9 of the bell crank 8 has a recess 14 the vertical boundary walls of which are of arcuate configuration. In this recess 14 there is pivotably mounted, between the arcuate boundary walls, a cross-bar 15 of insulating material to each of the two ends of which a respective U-shaped contact carrier 16 is secured. One arm of the contact carrier 16 carries a movable contact 17 which in the switched on positions of FIGS. 1 and 2 contacts a fixed contact 18 secured to a terminal 19. The other arm of the U-shaped contact carrier 16 is connected electrically, via a length of wire braiding 20, to a terminal 21. Thus the switch has two spaced apart parallel identical current circuits. Between the enlarged lower end of the switching bar 6 and the leg 7 of the bell crank 8 a compression spring 22 is provided on the switching bar 6, which spring is somewhat weaker than a disconnection spring 23 also in the form of a compression spring and also disposed on the switching bar 6, between the push-button 4 and an insulating disc 24 supported by the bottom of the recesses 5. The switching bar 6 passes with clearance through a corresponding bore of the insulating disc. At the lower end of the switching bar 6 the switching bar has an attachment 25 which in the switched on position of FIG. 1 urges a contact spring 26 against the terminal 21. The contact spring 26 is formed in one piece with a terminal 27.

Figure 5:
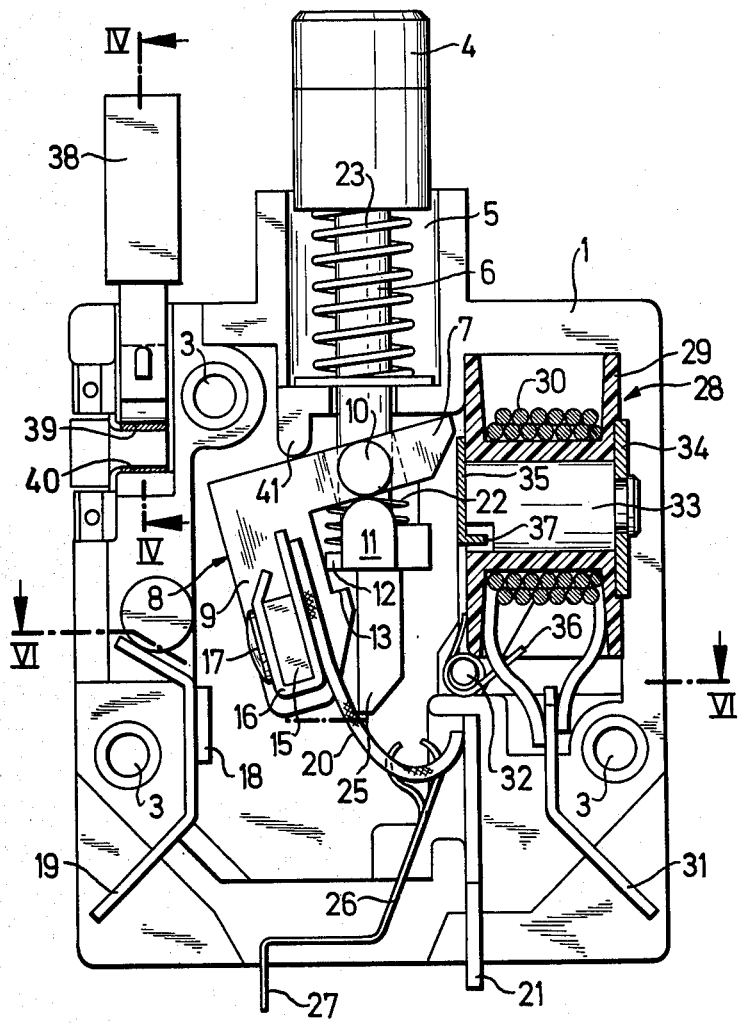
FIG. 5 shows the same view as FIG. 1, but with the circuit breaker in its switched-off condition.

In suitable recesses of each housing member 1, 2 there is disposed on electromagnetic tripping device 28 including a coil body 29 with a coil 30 the ends of which are electrically connected to two terminals 31. The tripping device 28 further includes a magnet core 33, a magnet yoke 34 which encompasses the coil body 29 in U-configuration, and a pivotable armature 35 held in a non attracted position as in FIG. 1 by a torsion spring 36 disposed on a pivot shaft 32 of the armature. As can be seen in FIG. 5 in particular, the armature 35 has a recess and a retaining protuberance 37 bent at a right angle and supporting the leg 7 of the bell crank 8 in the switched on position of FIG. 1.

In suitable recesses of each housing member 1, 2 there is vertically displaceably mounted a test key 38 acting on a pivotable contact spring 39 which co-operates with a fixed contact spring 40. Both contact springs 39 and 40 are connected in the circuit of the coil 30 which can be selectively energised and thus tested by means of the test key 38.

The present circuit breaker operates in the following manner:-

The coil 30 is connected to an electronic circuit which serves to determine a faulty current fed to the coil 30. As soon as the faulty current reaches a specific value e.g 5 mA, the electromagnet attracts the armature 35 so that the latter passes into the FIG. 5 position. Its retaining protuberance 37 releases the bell crank 8 so that by the action of the disconnection spring 23 the bell crank 8 moves into the switched off position of FIG. 5 in which position the bell crank 8 is positioned obliquely relative to the FIG. 1 connection position, by a stationary stop 41, as can be clearly seen in FIG. 5. The disconnection spring 23 effects an instantaneous disconnection. If during this release the push-button is constrained in the FIG. 1 position so that the disconnection spring 23 is ineffective, then the compression spring 22 causes the bell crank 8 with the movable contacts 17 to be displaced into the disconnection position of FIG. 5. This release is a trip-free release. During release the attachment 25 of the switching bar 6 frees the contact spring 26 so that the latter lifts off the terminal 21 (FIG. 5).

When the push-button 4 is operated in the switched off position of FIG. 5, then the member 12 of the switching bar 6 entrains the abutment 13 of the bell crank 8 and causes the leg 7 of the bell crank to engage behind the retaining protuberance 37 of the armature 35. The thereby attained lowest position of the bell crank 8 is indicated by thin dot-dash lines in FIG. 1. When the push button is now released, the bell crank 8 is rotated, by the action of the compression spring 22, clockwise in FIG. 5, about the retaining protuberance 37 as fulcrum. Thereby the abutment 13 slides off the drive member 12 just prior to the connection position being reached, so that subsequently the rotation of the bell crank 8 under the action of the compression spring 22 proceeds abruptly, so that the movable contacts 17 also abruptly come to contact the fixed contacts 18 and thus an instantaneous connection has been obtained.

In this switched on position the attachment 25 of the switching bar 6 urges the contact spring 26 against the terminal 21. The contact spring 26 is thus leadingly connected and laggingly disconnected.

With the aid of the test key 38 it is at any time possible to check whether the tripping device 28 is in proper condition and ready to perform its function.

One terminal 31 or coil 30 is connected to the terminal 27 and the other terminal 31 is connected to the electronic circuit, so that when the push-button 4 is actuated the coil 30 is also energised.

I claim:

1. A push-button operated bipolar faulty current protective switch having two fixed contacts and two movable contacts, said fixed contacts co-operating with said movable contacts, and an electromagnetic tripping device which is actuated in dependence of a faulty current, such a circuit breaker comprising a switching bar, a bell crank made of electrically insulating material, a spring biased push-button, said push-button being rigidly connected to the switching bar, said bell crank including first and second leg members, said first leg member being arranged transversely of the switching bar so that it is freely pivotable thereon and displaceable axially thereof, said second leg member being arranged parallel to said switching bar, a cross member of an insulating material, said cross member having an abutment and being arranged on said second leg member and pivotally mounted about an axis substantially parallel to said switching bar and being provided at each of its ends with one of said movable contacts, said switching bar including a drive member, said drive member being adapted to engage said abutment on said second leg member in the switched off condition of said bell crank, a stop member, said stop member being adapted to maintain said bell crank at an angle to said switching bar in the switched off condition of said bell crank, so that it can be moved to the switched on condition, said electromagnetic tripping device including an armature provided with a protuberance, a spring, said protuberance being adapted to maintain said bell crank in its switched on condition against the bias of said spring.

2. A circuit breaker according to claim 1, which includes a U-shaped carrier on said cross member each of the movable contacts being arranged on one arm of said U-shaped carrier, the other arm of the said carrier being in electrical contact with a terminal of the circuit breaker.

3. A circuit breaker according to claim 1 in which the axially displaceable movement of said bell crank is achieved by means of aligned members on the first leg of the bell crank which are guided in means defining grooves which extend in the direction of movement of the push-button.

4. A circuit breaker according to claim 3, in which said switching bar includes shoulders which are also guided in said means defining said grooves.

5. A circuit breaker according to claim 2, which includes a pivotable contact spring provided with a terminal member, said spring being movable into contact with a terminal for the circuit breaker in the switched on position by means of a member on said switching bar.

6. A circuit breaker according to claim 1, which includes an additional pair of contacts, one of which is movable and the other of which is fixed, and a test key for actuating the further pair of contacts in order to energise the electromagnetic tripping device.

* * * * *